United States Patent [19]

Curry

[11] Patent Number: 4,915,996

[45] Date of Patent: Apr. 10, 1990

[54] TWIST-TIE

[75] Inventor: Thomas J. Curry, Wantagh, N.Y.

[73] Assignee: Bleyer Industries, Inc., Lynbrook, N.Y.

[21] Appl. No.: 228,292

[22] Filed: Aug. 4, 1988

[51] Int. Cl.[4] ..... B32B 7/12; D04D 7/10; B65D 77/10

[52] U.S. Cl. ..... 428/40; 24/30.5 R; 24/30.5 T; 383/70; 383/71; 383/78; 383/80; 428/4; 428/5; 428/457; 428/464

[58] Field of Search ..... 428/4, 5, 40, 464, 457; 24/30.5 R, 30.5 T; 383/70, 71, 78, 81

[56] References Cited

U.S. PATENT DOCUMENTS

| | | | |
|---|---|---|---|
| 2,368,838 | 1/1942 | James | 24/304 |
| 2,562,192 | 7/1951 | James | 428/5 |
| 2,562,919 | 8/1951 | James | 428/5 |
| 2,584,254 | 2/1952 | Brodbeck | 428/5 |
| 2,681,525 | 6/1954 | James | 428/5 |
| 2,849,171 | 8/1958 | O'Brien, Jr. | 383/71 |
| 2,973,597 | 3/1961 | Powell | 24/30.5 T |
| 3,174,886 | 10/1962 | Miscovich | 428/5 |
| 3,235,986 | 12/1962 | Blish | 428/4 |
| 3,311,288 | 4/1964 | Lemelson | 24/30.5 T |
| 3,409,948 | 11/1968 | Goodwin | 24/30.5 T |
| 3,412,926 | 11/1968 | Bostwick | 383/71 |
| 3,417,863 | 12/1968 | Paxton | 24/30.5 T |
| 3,539,431 | 11/1970 | Schmidt et al. | 428/4 |
| 4,201,806 | 5/1980 | Cole | 428/4 |
| 4,391,063 | 5/1983 | Gill, III | 24/30.5 T |
| 4,476,167 | 10/1984 | Dufler | 428/4 |
| 4,527,719 | 6/1985 | Mackrill | 428/4 |
| 4,529,636 | 7/1985 | Olsen | 206/820 |
| 4,621,732 | 11/1986 | Olsen | 428/40 |
| 4,634,612 | 1/1987 | Nelson et al. | 428/4 |
| 4,713,267 | 12/1987 | Truskolaski | 428/4 |

FOREIGN PATENT DOCUMENTS

| | | | |
|---|---|---|---|
| 974419 | 9/1950 | France | 24/30.5 T |
| 2173770 | 10/1986 | United Kingdom | 383/71 |

*Primary Examiner*—Ellis P. Robinson
*Assistant Examiner*—Archene Turner
*Attorney, Agent, or Firm*—Weingram & Zall

[57] ABSTRACT

In the apparatus of the present invention, a twist-tie is shown formed of a layered flexible material. A wire is affixed along the length of this layer of plastic material and adhesively engaged thereto. The surface of adhesive and the wire is over fixed with a peelable layer of material which covers the adhesive and the wire or the first layer. The entire assembly is cut to a desired length and, in the preferred embodiment, a decorative ribbon may be secured thereto as by a staple, adhesive, string, or any other means, the decorative ribbon is then capable of being secured to a package of a size such that the peelable layer can be removed and the adhesive can be employed directed to affix the ribbon to the package. Alternatively, the peelable layer may remain and the ribbon affixed to a smaller package by utilizing the invention in the manner of a standard twist-tie. The size of the package with which the twist-tie alone can be employed is a function of the length of the twist-tie used. Of course, if desired, the peelable layer can be removed in whole or in part and both the adhesive backing and the sticking twist-tie portion can be employed to secure the ribbon to the package.

10 Claims, 1 Drawing Sheet

TWIST-TIE

BACKGROUND OF THE INVENTION

1. Field of the Invention

The present invention relates to a twist-tie and specifically to a twist-tie which may be used to affix, secure, or adhere decorative ribbon or bow to a package.

2. Description of the Prior Art

The present invention relates to a two-way bow-tie having both an adhesive backing on a twist-tie which utilizes a solid flexible element such as wire adhered to the tie. The purpose of the combined twist-tie and adhesive backing is to enable the bowtie to be affixed to smaller packages (where the twist alone can be utilized) as well as to larger packages which require the adhesive backing because the length of wire incorporated in the twist-tie is insufficient to surround the entire package.

The prior art discloses a number of structures for securing a ribbon or bow to a package.

James, U.S. Pat. No. 2,368,838, affixes a ribbon or a bow to a package utilizing a special fixture which includes an adhesive backing and a thin flexible wire element formed in the fixture. The fixture is adhesively secured to the package and the bow tie secured to the wire element.

James, U.S. Pat. No. 2,562,192, discloses a package bow construction utilizing adhesive engagement only of the various portions of the bow and ribbon set for securing same to the package. James, U.S. Pat. No. 2,562,919, similarly teaches a decorative bow for adhering to packages where the bow is secured to the package and to the various overfolded and re-bent portions of the ribbon itself using adhesive.

Brodbeck, U.S. Pat. No. 2,584,254, teaches a bow including a primary bow portion, a secondary bow portion, a tying strip and an attaching plate. The tying strips in this patent are not utilized to adhere the bow to the package; however, the ends of typing strips may, if desired, be adhesively secured to the package. The principal method of securing is accomplished adhesively by engaging the plates to the package.

James, U.S. Pat. No. 2,681,525, overfolds a number of flat layers and utilizes a fastener to secure the center of the flat layer to a fastening base.

Miscovich, U.S. Pat. No. 3,174,886, adhesively engages slitted parts of a rosette to a package. Blish, U.S. Pat. No. 3,235,986, refers to an adhesively bonded label which is secured to a package. A portion thereof is preformed along fold lines to stand out and extend from the adhered portion of the label.

Schmidt et al., U.S. Pat. No. 3,539,431, disclosures the securing of a decorative ribbon to a package via a holding card attached to the drawstring which is forced into a slit in the card. Adhesive is applied to the card. The ribbon is adhesively secured. The drawstring is not employed as alternative or additional ways of securing a bow to a package.

Cole, U.S. Pat. No. 4,201,806, affixes a ribbon via the use of a cord used with a stabilizing plate. The stabilizing plate element is slidably mounted on a loop of the cord. The stabilizing element is not adhesively engaged to the package. The stabilizing element is utilized in connection with the need to stabilize the ornament because of its construction and shape.

Duftler, U.S. Pat. No. 4,476,167, utilizes a substrate and a decorative ribbon. Mackrill, U.S. Pat. No. 4,527,719, features a backing plate and a length of tape secured to the backing plate. The tape is used to secure the ornament with a spring clip or safety pin as an alternative.

Nelson et al., U.S. Pat. No. 4,634,612, and Truskolaski et al., U.S. Pat. No. 4,713,267, contain identical disclosures relating to adhering ribbon fabric which employs adhering members formed in the ribbon fabric.

SUMMARY OF THE INVENTION

In the apparatus of the present invention, a twist-tie is shown formed of a layered flexible material. A wire is affixed along the length of this layer of plastic or paper material and adhesively engaged thereto. The surface of adhesive and the wire is over fixed with a peelable layer of material which covers the adhesive and the wire or the first layer.

The entire assembly is cut to a desired length and, in the preferred embodiment, a decorative ribbon may be secured thereto as by a staple, adhesive, string, or any other means.

The decorative ribbon is then capable of being secured to a package of a size such that the peelable layer can be removed and the adhesive can be employed directed to affix the ribbon to the package. Alternatively, the peelable layer may remain and the ribbon affixed to a smaller package by utilizing the invention in the manner of a standard twist-tie. The size of the package with which the twist-tie alone can be employed is a function of the length of the twist-tie used. Of course, if desired, the peelable layer can be removed in whole or in part and both the adhesive backing and the sticking twist-tie portion can be employed to secure the ribbon to the package.

A principal object of the present invention is the provision of a twist-tie which can be used to affix decorative bows to packages.

Another object of the present invention is the provision of a twist-tie which can affix a bow directly to a package by twisting the sticking portion of the tie about a package.

A further object of the present invention is to provide a layer of adhesive on the surface of the twist-tie, the layer of adhesive being covered with a peelable layer of material.

A still further object of the present invention is to provide a removable layer of material such that the twist-tie can form an exposed adhesive layer thereon.

It is an object of the present invention to employ an adhesive layer alternatively to or in addition to the twist-tie arrangement so that the twist-tie can be utilized on all sizes of packages.

A further object of the present invention is to provide a twist-tie which can adhesively engage a package with the adhesive surface incorporated in the twist-tie and without utilizing the twist-tie to mechanically secure the tie to the package.

A still further object of the present invention is to provide a dual mounted twist-tie which can be employed either in a twisted fashion where the tie is mechanically surrounding the package or adhesively by peeling the protective layer from the twist-tie exposing an adhesive backing which can be affixed directly on or a portion of the package.

These as well as further objects and advantages of the invention will become apparent to those skilled in the art on review of the accompanying drawings.

DETAILED DESCRIPTION OF THE INVENTION

Figure 1:
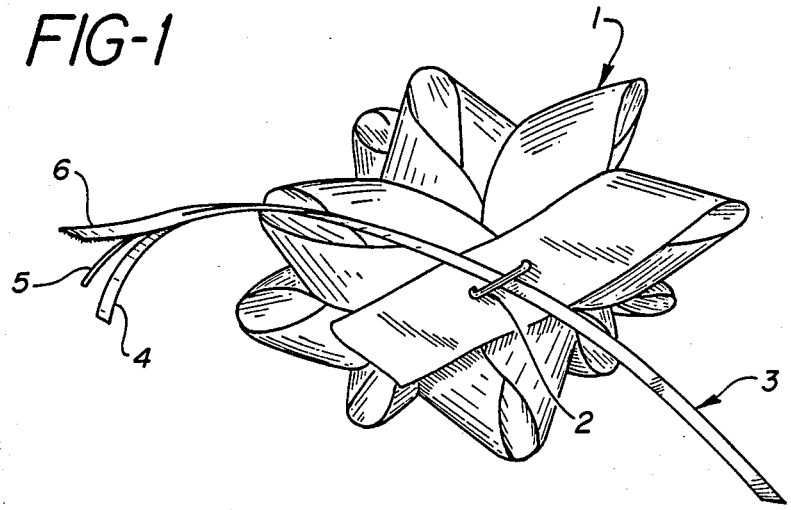
FIG. 1 is a perspective view of the twist-tie and ribbon assembly of the present invention.

FIG. 1 shows a perspective view of the twist-tie of the present invention affixed to a decorative bow 1. The material of which the bow 1 is formed, its shape and its construction, being a part of the present invention. Suffice it to say that the only requirement is that the bow 1 be secured to the twist-tie of the present invention shown generally at 3 by a suitable means such as a staple 2 or other securing mechanism such that the bow 1 is not easily moved from twist-tie 3.

The tie 3 has three distinctive layers 4, 5 and 6 thereon. Layer 4 is a peelable layer formed of a cloth, paper or a plastic material. This peelable layer is secured to the adhesive applied to the bottom layer 6. Layer 6 may also be formed of a cloth, paper or a plastic material. The adhesive utilized to secure the peelable layer 4 to the base layer 6 can be any suitable commercially available adhesive.

Affixed between base layer 6 and peelable layer 4 is a wire stiffener rod 5. This stiffener rod is also adhesively engaged to the base layer 6. The stiffener rod 5 is a flexible wire rod formed in a manner similar to the well known twist-ties which are commercially available.

Figure 2:
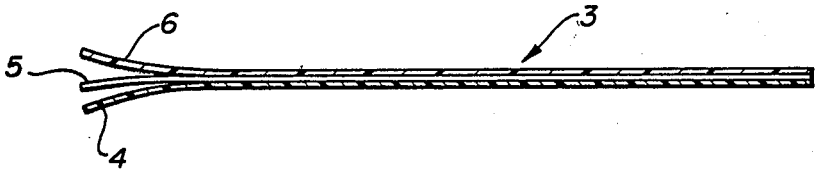
FIG. 2 is a side view showing the layers of the twist-tie incorporated in the invention of FIG. 1.

FIG. 2 is a side view showing the three layers 4, 5 and 6 of the twist-tie 3. These layers are shown separated from each other at one end thereof; however, it is to be understood that the layers 5 and 6, namely the stiffening rod and the base layer respectively, are not separable one from the other. Peelable layer 4, however, is separable.

In operation, the ribbon 1 is affixed to a package utilizing the securing force of the flexible wire stiffener 5 alone or the device can be utilized in whole or in part by exposing the layer of adhesive by peeling away and discarding all or a portion of peelable layer 4.

In this manner, Applicant has provided a dual function tie which permits both mechanical securing or adhesive securing or a combination of both to be employed.

It is to be understood that the invention is not limited to use with decorative ribbons or bows, but to any item where the size of the device to which the item is to be affixed is variable such that either an adhesive securing or mechanical twist-tie securing can be employed singularly or in combination to affix the item to the device.

Modifications to the foregoing may be made without departing from the spirit and scope of my invention. The foregoing is intended as illustrative and not as limiting.

I claim:

1. A twist-tie comprising:
   - a base layer;
   - flexible wire stiffening means affixed to said base layer for securing said twist-tie to a surface;
   - an adhesive formed on said base layer for enabling said twist-tie to be affixed to a surface; and
   - peelable means covering said adhesive and peelably secured to said base layer by said adhesive to expose said adhesive to said surface;
   - said wire-stiffening means disposed between said base layer and said peelable means, and said peelable means at least as large as said adhesive.

2. The twist-tie of claim 1, wherein said base layer and said peelable means are formed of plastic.

3. The twist-tie of claim 1, wherein said base layer and said peelable means are formed of paper.

4. The twist-tie of claim 1, wherein said stiffening means comprises a metallic wire.

5. The twist-tie of claim 1, wherein said base layer and said peelable means are formed of cloth.

6. A fastening device for securing an object to a surface, said device comprising:
   - tying means including a flexible wire means for tying said device to a surface;
   - adhesive means formed on said first named means in contact with said wire means for adhesively engaging said device to said surface; and
   - peelable means substantially fully covering and engaging said adhesive means for exposing said adhesive on removal of said peelable means.

7. The device of claim 6, wherein said wire means is soft metallic wire.

8. The device of claim 6, wherein said peelable means is formed of paper.

9. The device of claim 6, wherein said peelable means is formed of plastic.

10. The device of claim 6, wherein said peelable means is a panel of cloth.

* * * * *